US011338348B2

(12) United States Patent
Zhang et al.

(10) Patent No.: US 11,338,348 B2
(45) Date of Patent: May 24, 2022

(54) METHOD AND APPARATUS FOR DOUBLE-SIDED INCREMENTAL FLANGING

(71) Applicants: Northwestern University, Evanston, IL (US); Shanghai Jiao Tong University, Shanghai (CN)

(72) Inventors: Huan Zhang, Shanghai (CN); Jian Cao, Wilmette, IL (US); Kornel Ehmann, Evanston, IL (US); Jun Chen, Shanghai (CN)

(73) Assignees: NORTHWESTERN UNIVERSITY, Evanston, IL (US); SHANGHAI JIAO TONG UNIVERSITY, Shanghai (CN)

( * ) Notice: Subject to any disclaimer, the term of this patent is extended or adjusted under 35 U.S.C. 154(b) by 42 days.

(21) Appl. No.: 16/613,885

(22) PCT Filed: May 14, 2018

(86) PCT No.: PCT/US2018/032505

§ 371 (c)(1),
(2) Date: Nov. 15, 2019

(87) PCT Pub. No.: WO2018/213162

PCT Pub. Date: Nov. 22, 2018

(65) Prior Publication Data

US 2020/0070235 A1 Mar. 5, 2020

Related U.S. Application Data

(60) Provisional application No. 62/506,039, filed on May 15, 2017.

(51) Int. Cl.
*B21D 31/00* (2006.01)

(52) U.S. Cl.
CPC ..... *B21D 31/005* (2013.01)

(58) Field of Classification Search
CPC ..... B21D 31/005; B21D 19/02; B21D 19/00; B21D 22/14; B21D 22/18; B21D 11/20
See application file for complete search history.

(56) References Cited

U.S. PATENT DOCUMENTS 4,055,067 A 10/1977 Kozima
4,802,355 A * 2/1989 Ezell ..... B21D 19/043 72/112

(Continued)

FOREIGN PATENT DOCUMENTS

CN 104259308 A * 1/2015 ..... B25J 9/1682
EP 1977842 A1 10/2008

(Continued)

OTHER PUBLICATIONS

KR-20110014005-A Machine Translation, 2011 (Year: 2011).*

(Continued)

*Primary Examiner* — Adam J Eiseman
*Assistant Examiner* — Kevin E O'Brien
(74) *Attorney, Agent, or Firm* — Banner & Witcoff, Ltd.

(57) ABSTRACT

Flanges formed on sheet metal parts to increase the part stiffness or create mating surface for further assembly are created in an incremental sheet forming process using forming tool and supporting tool that move along a specified tool path so as to gradually deform a peripherally-clamped sheet metal work piece into the desired geometry. With two universal tools moving along the designed toolpath on the both sides of the part, the process is very flexible. Process time is can also be reduced by utilizing an accumulative double-sided incremental hole-flanging strategy, in which the flange is formed in only one step.

14 Claims, 6 Drawing Sheets

(56) References Cited

U.S. PATENT DOCUMENTS

| | | | | |
|---|---|---|---|---|
| 5,676,901 | A | 10/1997 | Higashi et al. | |
| 8,302,442 | B2 * | 11/2012 | Kiridena | B21D 31/00 72/115 |
| 8,783,078 | B2 * | 7/2014 | Ren | B21D 31/005 72/83 |
| 9,168,580 | B2 | 10/2015 | Cao et al. | |
| 10,744,549 | B2 * | 8/2020 | Watanabe | B21C 51/00 |
| 2001/0029768 | A1 | 10/2001 | Okada et al. | |
| 2009/0158805 | A1 | 6/2009 | Callebaut et al. | |
| 2010/0199742 | A1 | 8/2010 | Johnson et al. | |
| 2012/0024035 | A1 | 2/2012 | Kiridena et al. | |

FOREIGN PATENT DOCUMENTS

| | | | | |
|---|---|---|---|---|
| KR | 20110014005 A * | 2/2011 | | B21D 11/02 |
| KR | 1282750 B1 * | 7/2013 | | B21D 26/14 |

OTHER PUBLICATIONS

KR-1282750-B1 Machine Translation, 2013 (Year: 2013).*
CN-104259308-A Machine Translation, 2015 (Year: 2015).*
Malhotra, R., Reddy, N.V., Cao, J., Automatic 3D Spiral Toolpath Generation for Single Point Incremental Forming, Journal of Manufacturing Science and Engineering, (Dec. 2010), vol. 132, pp. 061003/1-061003/10. (Year: 2010).*
Jeswiet, J., Micari, F., Hirt, G., Brameley, A., Duflou, J., Allwood, J., Asymmetric Single Point Incremental Forming of Sheet Metal, CIRP Annals—Manufacturing Technology, (2005) vol. 54(2), pp. 88-114. (Year: 2005).*
T. Wen et al, Bi-directional dieless incremental flanging of sheet metals using a bar tool with tapered shoulders, 2016, Elsevier B.V. Journal of Materials Processing Technology, 229, 795-803 (Year: 2016).*
Aug. 3, 2018—(WO) International Search Report and Written Opinion—APP PCT/US2018/032505.
Z. Cui and L. Gao, Studies on hole-flanging process using multi-stage incremental forming, CIRP Journal of Manufacturing Science and Technology 2 (2010) 124-128.
A. Peter, K. Kuzman and R. Fijavz, Backward drawing of necks using incremental approach, Key Engineering Materials, vol. 473, pp. 105-112 (2011).
T. Cao, B. Lu, H. Ou and J. Chen, Investigation on a new hole-flanging approach by incremental sheet forming through a featured tool, International Journal of Machine Tools & Manufacture 110 (2016)1-17.
Holger Voswinckel, Markus Bambach and Gerhard Hirt, Improving geometrical accuracy for flanging by incremental sheet metal forming, Int J Mater Form (2015) 8:391-399.
M. Bambach, H. Voswinckel, G. Hirt, A new process design for performing hole-flanging operations by incremental sheet forming, Procedia Engineering 81, 2305-2310, (2014).
Tong Wen Suo Zhang Jie Zheng Qian Huang and Qing Liu, Bi-directional dieless incremental flanging of sheet metals using a bar tool with tapered shoulders, Journal of Materials Processing Technology 229 (2016) 795-803.

* cited by examiner

METHOD AND APPARATUS FOR DOUBLE-SIDED INCREMENTAL FLANGING

This application is a U.S. National Stage application under 35 U.S.C. § 371 of International Application PCT/US2018/032505 (published as WO 2018/213162 A1), filed May 14, 2018 which claims the benefit of priority to U.S. Application Ser. No. 62/506,039, filed May 15, 2017. Each of these prior applications are hereby incorporated by reference in their entirety.

STATEMENT OF GOVERNMENT INTERESTS

This invention was made with government support under grant number DE-EE0005764 awarded by the U.S. Department of Energy. The government has certain rights in the invention.

BACKGROUND

Incremental sheet forming (ISF) is a rapid manufacturing process that uses a forming tool that moves along a designed toolpath so as to gradually deform a peripherally clamped sheet metal work piece into a desired geometry. Compared with conventional stamping, ISF does not require specific dies nor press and thus reduces the lead time and cost. Moreover, with the stylus-type forming tool moving along a free predefined 3D trajectory, a free-form surface can be easily achieved with ISF.

In addition to the process flexibility, the forming limits in ISF is constrained by fracture forming limit line (FFL), which is higher than the forming limit curve (FLC) used in stamping. With the development of ISF, variations such as two point incremental forming, double-sided incremental forming (DSIF), accumulative double side incremental forming and hybrid incremental sheet forming have been developed to expand the process application.

Hole-flanges, conventionally produced by press-working, are widely used in the industry to attach tubes or enhance the part's shape. Due to its advantages described above, ISF becomes an alternative to rapidly fabricate the flanges in trial manufacture. Utilizing single point incremental forming (SPIF) in hole-flanging was first proposed by Cui and Gao in 2010 [1]. They experimentally investigated the influence of three different multi-stage toolpaths on the forming limits of AA1060 aluminum blanks with different pre-cut hole-diameters. Instead of forming from the top down, Petek et al, [2] studied the feasibility of multi-stage backward SPIF toolpaths in both symmetric and asymmetric hole-flanging. T. Cao et al. [3] developed a flanging tool and forming from the inside out instead of forming from the top down. Besides symmetric hole-flanging, Voswinckel et al. [4] further investigated the feasibility of stretch and shrink boundary flanging by multi-stage SPIF. The above studies proved the capability of SPIF for hole-flanging.

FIG. 6 illustrates the incremental flanging process according to the prior art. Tool 140 is employed to form the flange 20, while the boundary of flange 20 is not constrained. Different forming tool paths may be used to form flange 20. FIG. 7 illustrates products created by incremental forming according to the prior art, Part 10, with fillet 20*a* and vertical wall 20*b*, is the target geometry, Due to the insufficient boundary material stiffness, part 11, with an uncontrolled fillet 11*a* and a partly obtained wall 11*b*, may result. Due to the unconstrained boundary material, part 12, with a bulging fillet 12*a* and a partly achieved wall 12*b*, may result. These two parts may be formed with different materials, tool path strategies and backing plate.

The aforementioned experiments exclusively focus on SPIF, requiring custom-built blank holders to achieve flanges, Use of such custom-built blank holders reduces the process flexibility and increases the lead time and cost. Bambach et al. [5] presented a modified SPIF hole-flanging with an adaptive top blank holder and an eccentric tool tip, which improved the process efficiency and reduced the occurrence of bulges in the sheet adjacent to the hole. However, this complex design is only suitable for symmetric hole-flanging, which places a limit on the process application, Recently, Tong Wen et al. [6] used a bar tool with tapered shoulders to produce flanges of both open edges and hole rims. Tools with various taper angles were tested to balance the warpage and bulge. However, this restricted the versatility of the tool, and required trial and error. Besides, the fillet was unable to be achieved because of the lack of the blank holder.

By way of the present application, a double-sided incremental flanging system and method are provided. Double-sided incremental flanging is an application of the double-sided incremental forming. Tools are specially designed for the flanging process. A top tool mainly works as the forming tool and prevents the potential bulging, while a bottom tool is employed as a support and reduces the possible warpage. An accumulative double-sided incremental forming strategy is used for flanging. With the two tools moving together from inside to outside, the blank material is bent and squeezed so that it flows along the tool curvature from horizontal direction to vertical direction. Thus, the vertical wall of the flange is achieved, with the fillet radius being controlled by the tool curvature during the material flow.

SUMMARY

In this application, a simplified double-sided incremental flanging method will be illustrated. As noted above, double-sided incremental forming is a variation of ISF that employs two forming tools, one on each side of the blank, like double-sided incremental forming. However, the tool is specially designed according to the DSIF flanging process. The tool comprises a top member and a bottom member. The top member mainly works as the forming tool and prevents the potential bulging, while the bottom member is employed as a support tool and reduces the potential warpage. The top member and bottom member have complementarily-shaped surfaces corresponding to the profile of the flange to be formed. The top and bottom members define a line of contact between the two members and the work piece as they are brought together.

The tool path employed is from inside out, which is similar to the accumulative double-sided incremental forming toolpath. However, the forming zones are different between them. The forming zone in accumulative incremental forming is a point contact between the tool and the work piece, while in the double-sided incremental flanging method the forming zone is a line of contact between the tool and the work piece.

Consequently, the increment step size of the tool path in-plane is not decided by the wall angle of the target geometry. Instead, the step size is selected to control the in-plane forming force, and is preferably reduced gradually in order to minimize the growth rate of in-plane forming force. The tool path may be either concentric circles, or a spiral. With the two tools moving together from inside to outside, the blank material is bent, squeezed and flows along the tool curvature from horizontal direction to vertical direction in cross section view. Thus, the vertical wall of the flange is achieved, with the fillet radius controlled by the tool curvature during the material flow. Further deformation, extension in the circumferential direction or bending in cross section view, happens depending on the target flange geometry or the formability of the work piece.

In a first aspect, a double-sided incremental forming tool for forming a flange in a work piece is provided, in which the work piece defines an X-Y plane and the flange to be formed defines a profile having a first portion in the X-Y plane of the work piece and a second portion extending in a direction out of the X-Y plane of the work piece. The tool comprises a forming member and a support member, each of which is configured to be mounted in a tool holder. The forming member comprises a forming surface defining the profile of the flange, with a first forming surface parallel to the X-Y plane of the work piece, while the support member comprises a forming surface also defining the profile of the flange and complementary to the forming surface of the forming tool.

In a second aspect, the flange to be formed thereby has a second portion extends perpendicularly to the plane of the work piece in a Z direction and a fillet has a radius of curvature intermediate the first and second portions. The forming member further comprises three forming surfaces, with a second forming surface extending in the Z direction perpendicular to the X-Y plane of the work piece, and a third forming surface intermediate the first and second forming surfaces having a radius of curvature corresponding to the radius of curvature of the fillet. The support member further comprises two forming surfaces, with a first forming surface extending in the Z direction perpendicular to the plane of the work piece, and a second forming surface having a radius of curvature corresponding to the radius of curvature of the fillet, Preferably, the second forming surface of the forming tool and the first forming surface of the support member have a length in the Z direction greater than or equal to the height of the flange.

In a third aspect, a method is provided for forming a flange in a planar work piece defining an X-Y plane, the work piece having an aperture therein defined by a continuous, closed edge, and the flange having a first portion in the X-Y plane of the work piece and a second portion extending in a direction out of the plane of the work piece. The method comprises mounting the work piece in a blaink holder; mounting a forming tool and a support tool as described above in the tool holders so as to maintain a fixed, spaced relationship between the forming tool and the support tool; engaging the edge of the aperture with the forming tool; and moving the tool holders in unison in the X-Y plane while maintaining the fixed spacing between the forming tool and the support tool so as to continuously engage the edge of the aperture and deform the edge of the aperture to form the flange.

The tools may be moved in either a concentric or spiral path in the X-Y plane from the edge of the aperture outward, with each successive incremental step or orbit being smaller than the preceding step.

DETAILED DESCRIPTION

In accordance with the present method, a one-stage hole-flanging strategy is employed in which the forming tool and support tool are moved in unison from an initial position engaging the edge of the aperture formed in the work piece in an outward direction until the desired boundary of the flange is achieved, with the space between the complementarily-shaped surfaces of the working tool and the supporting tool corresponding to the thickness of the work piece. The tool path is essentially only in the plane of the work piece (the X-Y plane, as illustrated), and provides a forming zone in a line, with the relative positions of the forming tool and support tool being fixed.

Thus, the supporting tool engages the blank along the boundary of the forming area, rather at the target boundary. Further the forming and supporting tools engage the work piece in a line of contact. Such a tool path forms the vertical-wall directly, and has been found to achieve better geometric accuracy and changes the thickness distribution. Furthermore, with the fillet controlled by the supporting tool radii, the bulge in the unformed area is almost eliminated, and complex profiles including both shrink flanges and stretch flanges can be successfully achieved.

To illustrate the flanging process, a circle hole-flanging cross section is shown and described. In a circular flange, a "shrink flange" is formed. However, it should be understood that the apparatus and method are also applicable to forming asymmetric flanges and flanges that include both shrink flange portions and stretch flange portions.

Figure 1:
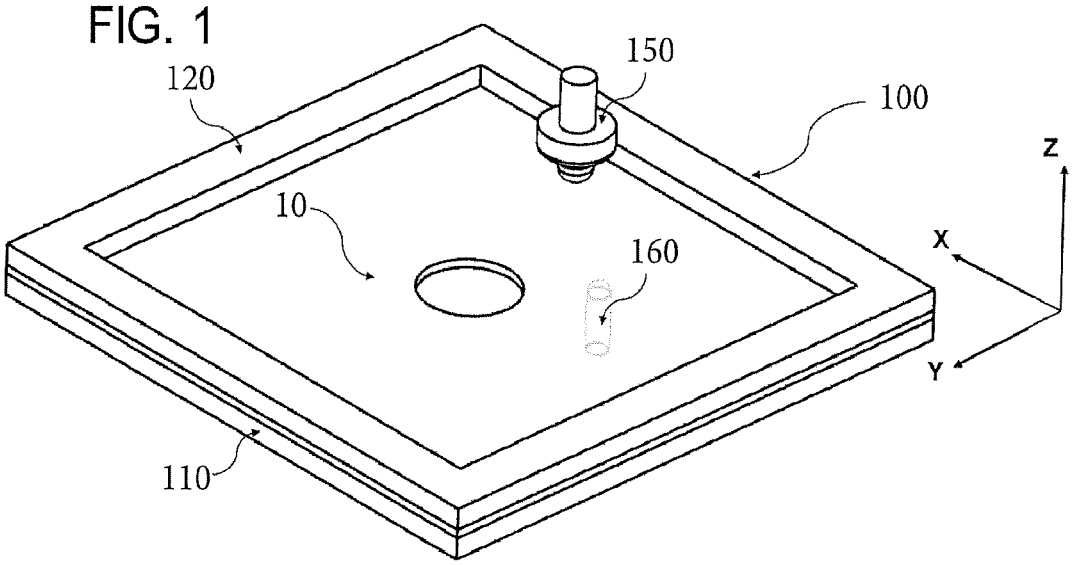
FIG. 1 is a simplified perspective view of a double-sided incremental flanging apparatus according to the present disclosure.
Figure 5:
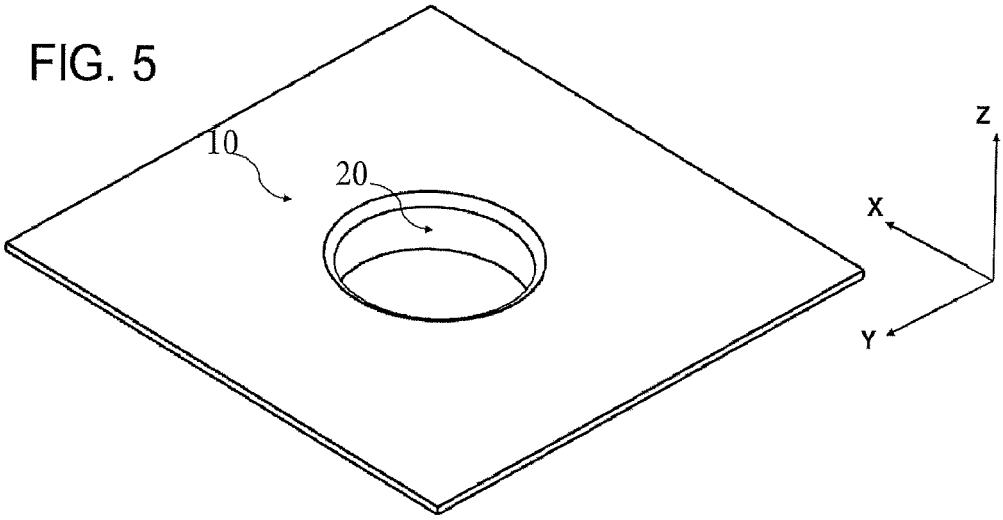
FIG. 5 is a perspective view of a target geometry according to the incremental flanging apparatus and method of the present disclosure.
Figure 6:
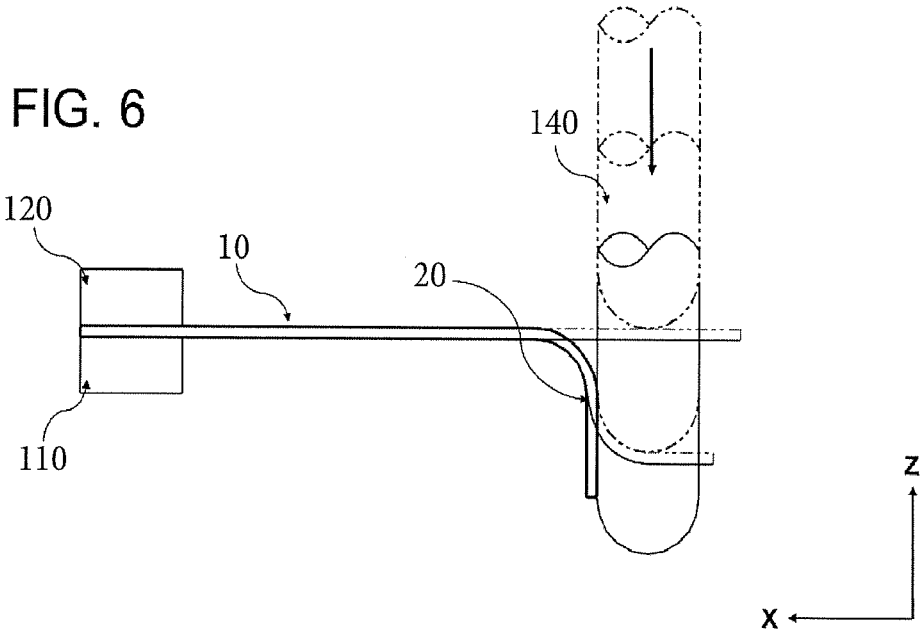
FIG. 6 is a fragmentary side view illustrating the incremental flanging process according to the prior art.
Figure 7:
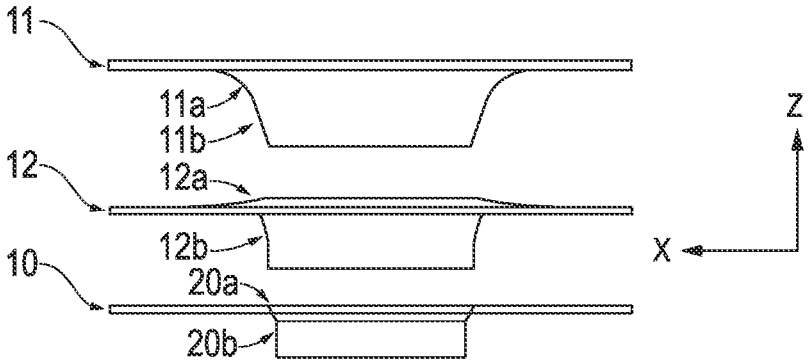
FIG. 7 is a side view of three different products created by the incremental flanging process according to the prior art.

FIG. 5 illustrates an exemplary target geometry for the flange to be formed. In this example, flange 20 is the target feature on part 10. It contains fillet 20*a* and vertical wall 20*b* (as shown in FIG. 7). As shown in FIG. 1, incremental forming apparatus 100 comprises a lower clamp 110 and an upper clamp 120. The blank 10 is mounted between the lower clamp 110 and upper clamp 120. Further details as to the forming apparatus may be found in, e.g., U.S. Pat. No. 9,168,580, which is incorporated herein by reference.

Figure 2:
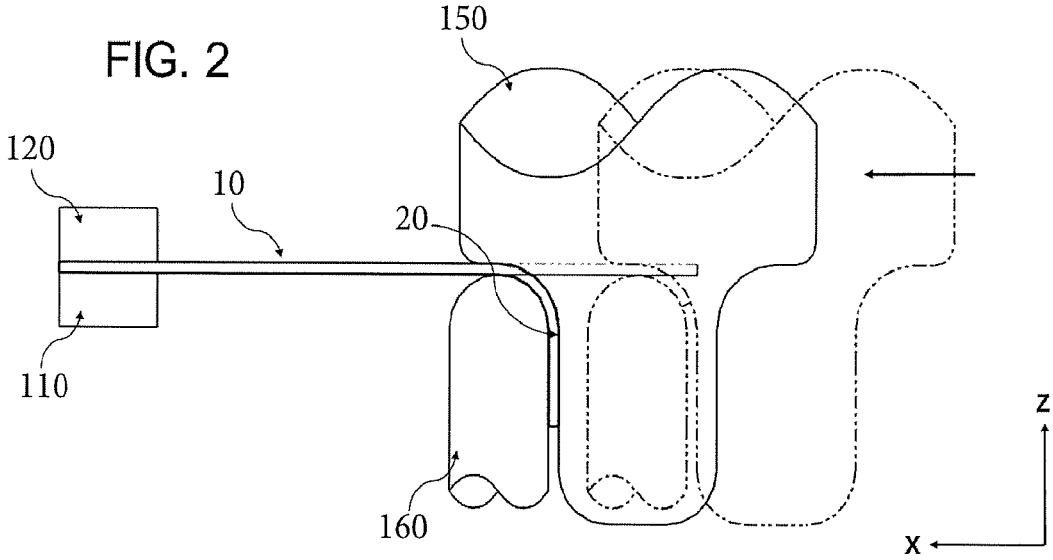
FIG. 2 is a simplified cross-sectional view showing the double-sided incremental flanging process according to the incremental forming apparatus of FIG. 1.
Figure 4:
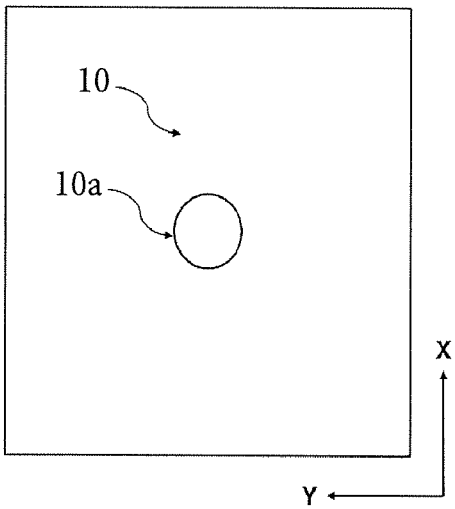
FIG. 4 is a plan view showing a blank or work piece having a circular aperture for use in the incremental flanging apparatus and method of the present disclosure.

A forming tool 150 and supporting tool 160 are provided that are mounted in tool holders/spindles (not shown) so as to be disposed on each side of the blank and movable relatively along the X, Y and Z direction. With reference to FIG. 2, the, tool 150 is moved to touch the edge 10*a* of the aperture in the blank (as shown in FIG. 4, in which 10*a* is the initial hole for flanging, which can be obtained with laser cutting or water jet cutting). The tools are then moved from inside out in the in-plane direction.

More specifically, the shoulder of tool 150 (150*c* in FIG. 3) contacts the blank surface and the edge 10*a* touches the fillet of tool 150. At the same time, tool 160 is moved to contact the other side of the blank 10 while keeping the distance between tool 150 and tool 160 in both the Z direction and in-plane direction to correspond to the blank thickness.

Figure 11:
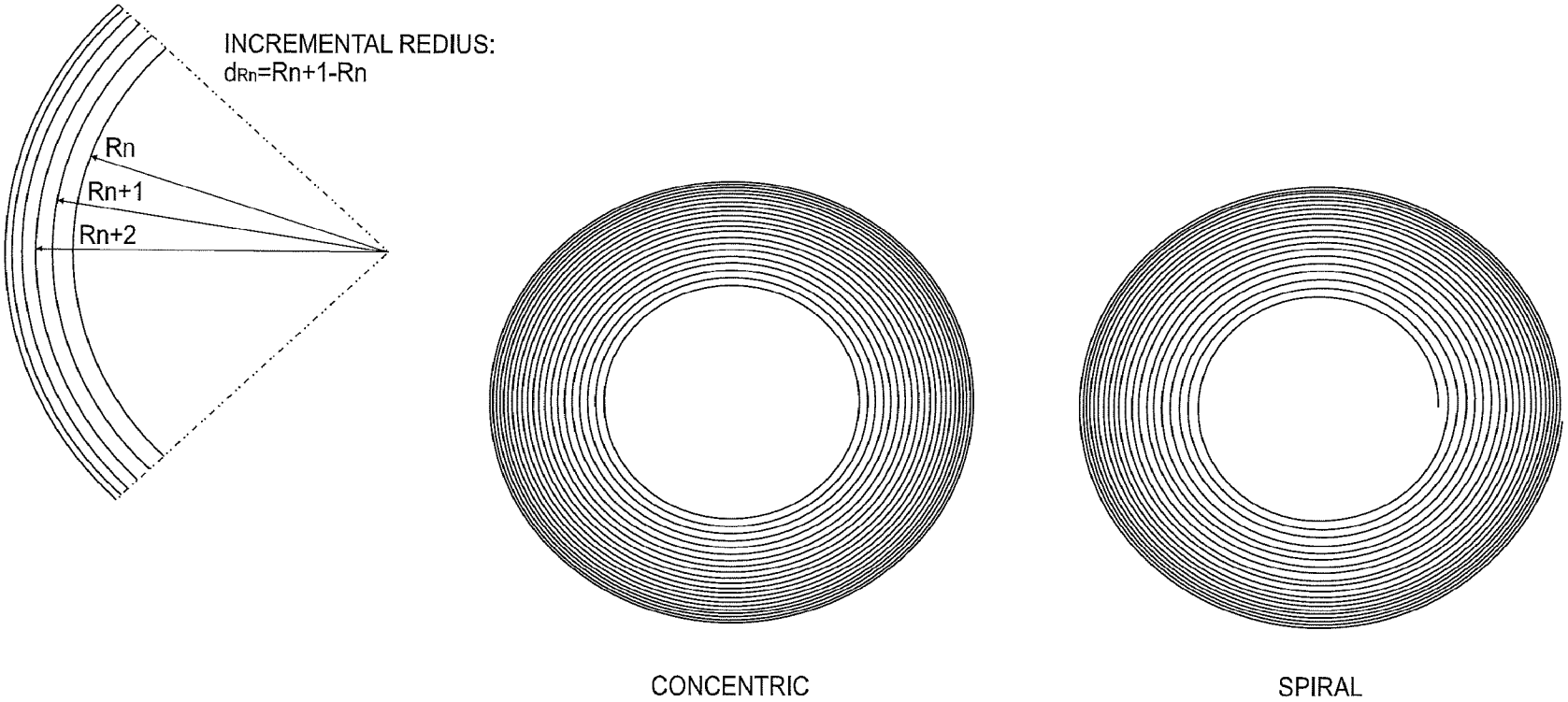
FIG. 11 shows two alternative tool paths, concentric and spiral, that may be utilized in the method described herein.

Next, tool 150 and tool 160 are gradually moved together along a tool path from inside to outside in an in-plane direction (either in concentric or a spiral shapes, as shown in FIG. 11), with the distance between them being maintained. During this process, the blank material is bent and flows along the curvature of the tool from in-plane direction to vertical direction. Flange 20 (as shown in FIG. 5) is achieved, With reference to FIG. 11, from one orbit of the flow path to the next, the incremental change in the radius, $dR_n$. (or, more specifically, the space between consecutive orbits) decreases from the inside of the aperture out. Thus, as the forming process proceeds, and the line of contact or forming line between the forming member, the support member, and the work piece increases, the incremental change is decreased in order to control the force exerted on the work piece in the X-Y plane.

Figure 3:
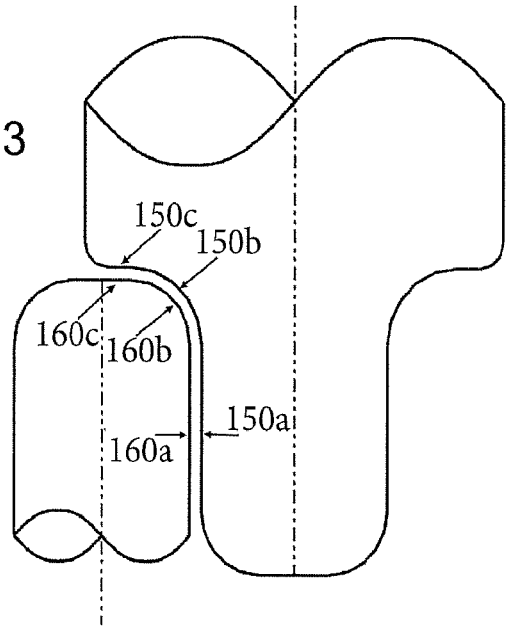
FIG. 3 is a fragmentary side view showing the tools for use in the incremental flanging apparatus and method of the present disclosure.

With reference to FIG. 3, details of the tools 150 and 160 for making the exemplary target geometry are shown. Specifically, both tools are designed to create the designed flange 20 in FIG. 5, Shoulder 150*c* and tip 160*c* works together to maintain the Z level of the blank. Curve 150*b* and curve 160*b* work together to guide the material flow and control the fillet of the flange 20. Vertical walls 150*a* and 160*a* constrain the achieved flange. Shoulder 150*c* and tip 160*c* may be revised according to the achieved part geometry before flanging. Curve 150*b* and 150*c* can be redesigned according to the desired flange cross section shape. 160*b* and 160*c* are designed to cooperate with 150*b* and 150*c*. The in-plane lengths of 150*c* and 160*c* can be adjusted to avoid possible collision with the part.

More particularly, it should be appreciated that the profiles of the tools 150 and 160 can be varied to create flanges having numerous different profiles, as long as profiles of the tools corresponds to the profile of the flange to be created, so that the line of contact defined by the tools is the same as the profile of the flange. Examples of different flange profiles that may be created using the method and tool described herein are shown in FIGS. 10(*a*)-10(*f*).

Figure 8:
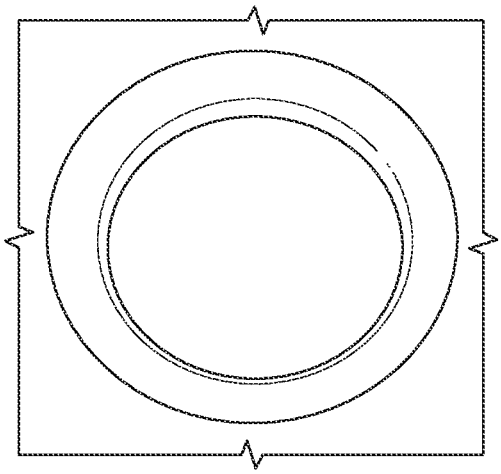
FIG. 8 is the photograph of a product created by the incremental flanging process according to the present disclosure.
Figure 9:
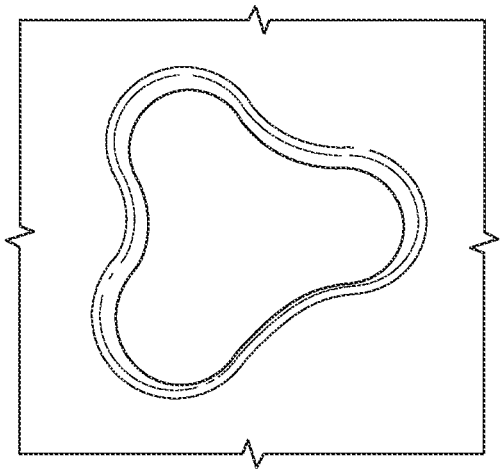
FIG. 9 is the photograph of an asymmetric product created according to the incremental flanging process of the present disclosure.
Figure 10A:
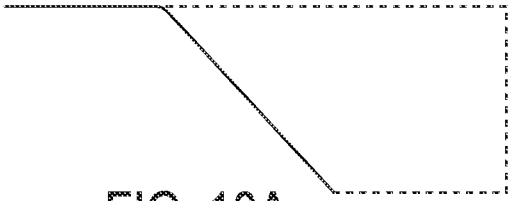
FIGS. 10(*a*)-10(*f*) are examples of alternative profiles for flanges that may be made according to the tool and method described herein.
Figure 10B:
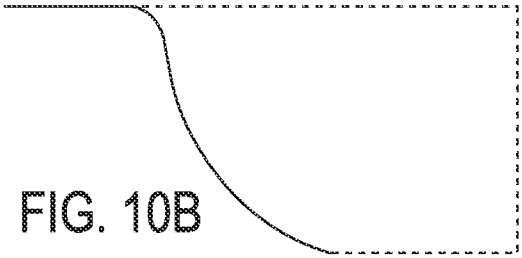
Figure 10C:
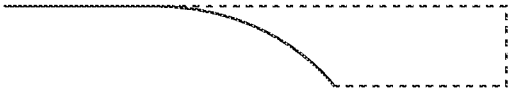
Figure 10D:
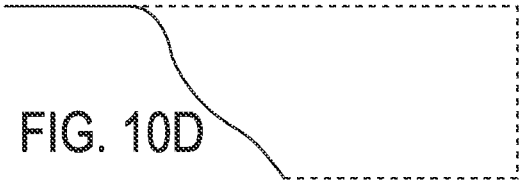
Figure 10E:
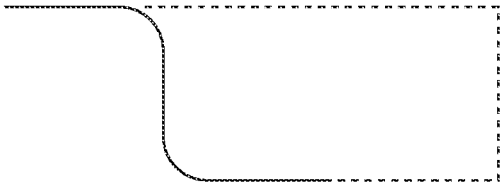
Figure 10F:
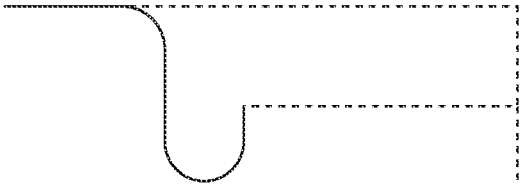

The tool and method have been used to create flanges in work pieces. FIG. 8 is a circle flange part formed with present method. FIG. 9 is an asymmetric flange part, having both shrink flange portions (where the curve of the flange is an outside curve, like in a circular flange) and stretch flange portions (where the curve of the flange is an inside curve) formed with the present method.

PUBLICATIONS

1. Z. Cui and L. Gao, Studies on hole-flanging process using multistage incremental forming, CIRP Journal of Manufacturing Science and Technology 2 (2010) 124-128.
2. A. Petek, K. Kuzman and R. Fijavž, Backward drawing of necks using incremental approach, Key Engineering Materials, Vol. 473, pp. 105-112 (2011)
3. T. Cao, B. Lu, H. Ou and J. Chen, Investigation on a new hole-flanging approach by incremental sheet forming through a featured tool, International Journal of Machine Tools & Manufacture 110 (2016)1-17.
4. Holger Voswinckel, Markus Bambach and Gerhard Hirt, Improving geometrical accuracy for flanging by incremental sheet metal forming, Int J Mater Form (2015) 8:391-399.
5. M. Bambach, H. Voswinckel, G. Hirt, A new process design for performing hole-flanging operations by incremental sheet forming, Procedia Engineering 81, 2305-2310, (2014)
6. Tong Wen Suo Zhang Jie Zheng Qian Huang and Qing Liu, Bi-directional dieless incremental flanging of sheet metals using a bar tool with tapered shoulders, Journal of Materials Processing Technology 229 (2016) 795-803.

The invention claimed is:

1. A method for forming a flange in a planar work piece defining an X-Y plane, the work piece having an aperture therein defined by a continuous, closed edge, and the flange having a first portion in the X-Y plane of the work piece, a second portion extending in and out of the plane of the work piece, the method comprising:

a) providing a forming tool comprising a forming surface defining a profile of the flange, with a first forming surface parallel to the X-Y plane of the work piece;

b) providing a support tool comprising a forming surface also defining the profile of the flange and complementary to the forming surface of the forming tool;

c) mounting the work piece in a blank holder;

d) mounting the forming tool and the support tool in tool holders so as to maintain a fixed, spaced relationship between the forming tool and the support tool;

e) engaging the edge of the aperture with the forming tool; and f) moving tool holders in unison in the X-Y plane, maintaining the fixed spacing between the forming tool and the support tool, to continuously engage the edge of the aperture and deform the edge of the aperture to form the flange; and wherein the tools are moved in a concentric path in the X-Y plane from the edge of the aperture outward in incremental steps, with each successive incremental step being smaller than preceding step.

2. The method of claim 1 in which the edge of the aperture is engaged by a third forming surface of the forming tool and the support tool is moved into contact with a surface of the work piece.

3. The method of claim 1 wherein the forming tool and the support tool are spaced apart a distance corresponding to a dimension of the work piece in the Z direction.

4. The method of claim 1 where in the fixed spacing between the tools in a horizontal direction corresponds to the thickness of the work piece.

5. The method of claim 1 wherein the aperture in the work piece is circular.

6. The method of claim 1 wherein the aperture in the work piece is non-circular.

7. The method of claim 6 wherein the aperture comprises both an outside curved portion (a "stretch" flange portion) and an inside curve portion (a "shrink" flange portion).

8. A method for forming a flange in a planar work piece defining an X-Y plane, the work piece having an aperture therein defined by a continuous, closed edge, and the flange having a first portion in the X-Y plane of the work piece, a second portion extending in and out of the plane of the work piece, the method comprising:

a) providing a forming tool comprising a forming surface defining a profile of the flange, with a first forming surface parallel to the X-Y plane of the work piece;

b) providing a support tool comprising a forming surface also defining the profile of the flange and complementary to the forming surface of the forming tool;

c) mounting the work piece in a blank holder;

d) mounting the forming tool and the support tool in tool holders so as to maintain a fixed, spaced relationship between the forming tool and the support tool;

e) engaging the edge of the aperture with the forming tool; and f) moving tool holders in unison in the X-Y plane, maintaining the fixed spacing between the forming tool and the support tool, to continuously engage the edge of the aperture and deform the edge of the aperture to form the flange; and wherein the tools are moved in the X-Y plane from the edge of the aperture outward in a spiral path, with each successive orbit in the spiral being a smaller step than the preceding step.

9. The method of claim 8 in which the edge of the aperture is engaged by a third forming surface of the forming tool and the support tool is moved into contact with a surface of the work piece.

10. The method of claim 8 wherein the forming tool and the support tool are spaced apart a distance corresponding to a dimension of the work piece in the Z direction.

11. The method of claim 8 where in the fixed spacing between the tools in a horizontal direction corresponds to the thickness of the work piece.

12. The method of claim 8 wherein the aperture in the work piece is circular.

13. The method of claim 8 wherein the aperture in the work piece is non-circular.

14. The method of claim 13 wherein the aperture comprises both an outside curved portion (a "stretch" flange portion) and an inside curve portion (a "shrink" flange portion).

* * * * *